US006751806B2

(12) United States Patent
Hinnant

(10) Patent No.: US 6,751,806 B2
(45) Date of Patent: Jun. 22, 2004

(54) BACKPACKING JACKET

(76) Inventor: Edward Hinnant, 425 9th St. South, Columbus, MS (US) 39701

( * ) Notice: Subject to any disclaimer, the term of this patent is extended or adjusted under 35 U.S.C. 154(b) by 0 days.

(21) Appl. No.: 09/931,566

(22) Filed: Aug. 16, 2001

(65) Prior Publication Data

US 2003/0033658 A1 Feb. 20, 2003

(51) Int. Cl.[7] ..... A41D 1/02
(52) U.S. Cl. ..... 2/108
(58) Field of Search ..... 2/86, 94, 108, 2/69, 93, 85, 115, 456–457, 69.5; 224/153, 575, 577, 580, 576, 613, 653–654; 383/4

(56) References Cited

U.S. PATENT DOCUMENTS

| | | | | | |
|---|---|---|---|---|---|
| 2,911,651 | A | | 11/1959 | Nye | |
| 2,967,306 | A | | 1/1961 | Fabanich | |
| 3,014,218 | A | | 12/1961 | Smith | |
| 3,085,254 | A | | 4/1963 | Cutler | |
| 4,389,735 | A | * | 6/1983 | McLaughlin | 2/94 |
| 4,563,777 | A | * | 1/1986 | Park | 2/108 |
| 4,689,831 | A | * | 9/1987 | Greenberger et al. | 2/93 |
| 5,123,117 | A | * | 6/1992 | Predergast | 2/108 |
| 5,165,111 | A | * | 11/1992 | Lieberman | 2/94 |
| 5,407,112 | A | * | 4/1995 | Christodoulou et al. | 224/153 |
| 5,526,969 | A | * | 6/1996 | Greenberger | 224/153 |
| 5,725,094 | A | * | 3/1998 | Moral | 206/314 |
| 6,047,413 | A | * | 4/2000 | Welchel et al. | 2/457 |
| 6,134,712 | A | * | 10/2000 | Spector | 2/94 |

OTHER PUBLICATIONS

"Lowe Pack Rain Cover", Campmor Cataglogue, Feb. 13, 2001.*

* cited by examiner

*Primary Examiner*—Tejash Patel
(74) *Attorney, Agent, or Firm*—Mark Murphey Henry

(57) ABSTRACT

A garment is disclosed comprising a back panel, means for tensioning the back panel about a backpack, and a front panel. The tensioning means extends around a front portion of the back panel, along upper, lower, and side portions of the back panel. The tensioning means may be a drawstring. The front panel may have a hood, arm openings, and sleeves. The back panel forms a back chamber sized to fit over a backpack. The back chamber preferably has a maximum volume of greater than or equal to approximately 2 cubic feet. The back chamber also preferably has a depth of greater than or equal to approximately 8 inches, a width of greater than or equal to approximately 18 inches, and a height of greater than or equal to approximately 24 inches. In use, the back panel is placed over a backpack with the front panel positioned between the back panel and the backpack. The backpack is then placed on the user's back. When the user wants to deploy the front panel, the user removes the front panel from between the back panel and the backpack without removing the backpack. The user may then place his or her arms through arm openings or sleeves and may place the hood over his or her head.

20 Claims, 3 Drawing Sheets

BACKPACKING JACKET

BACKGROUND OF THE INVENTION

This invention relates to a rain or wind resistant garment and, more particularly, to a rain jacket adapted for backpacking.

Rain and wind garments for use with a backpack are intended to keep a user and a backpack dry and warm. A number of attempts have been made to provide a rain or wind garment that is adapted for backpacking. For example, backpacking ponchos have been used to cover both the user and the backpack. A backpacking poncho can keep both a user and a backpack dry and warm, but it suffers from a number of drawbacks. For example, if the backpacking poncho is stored in the backpack, a user must typically remove the backpack to unpack the poncho. Further, loose fitting ponchos have a tendency to blow up in a windy rainstorm and often do a poor job of keeping a bottom portion of the backpack dry. Further still, the excess, loose fitting fabric may also interfere with a user's movements and dexterity. While a user is wearing a backpack, a poncho is also difficult to put on and take off.

Water resistant backpack covers are also used to keep a backpack dry. In an effort to protect themselves and their backpacks from rain, backpackers often put on rain gear such as water-resistant jackets, place water resistant backpack covers over their backpacks, and then put their backpacks on their backs. In this situation, the shoulder straps and waist belt of the backpack are not protected by the backpack cover or by the rain jacket, so the shoulder straps and waist belt have a tendency to become soaked even in a light rain. Further, water will often seep into a backpack as it runs down a backpacker's back and comes into contact with the unprotected portion of the backpack that is positioned against the backpacker's back. Ventilation is also a problem. Backpackers need clothing that can be easily vented to release body heat as hiking becomes more strenuous. Placing a backpack over conventional rain gear will typically significantly impair the functioning of vents. Vents are often rendered useless when the shoulder straps and waist belt of a backpack are secured and tightened over the vents. Placing the backpack over rain gear also greatly reduces the amount of airflow possible under the rain gear, through chest, armpit, and back vents. Similar to backpacking ponchos, if the rain gear is stored in the backpack, a user must typically remove the backpack to unpack the rain gear. Storage compartments have been provided in waist belts to allow access to rain gear or backpacking ponchos without the need to remove the backpack, but such storage compartments do nothing to overcome the other problems associated backpacking ponchos or rain gear.

Finally, oversized rain jackets have been used to cover both a user and a backpack. In one such version, the jacket is provided with a zipper that runs up the center of the back of the jacket over a large portion of the height of the back. The zipper is provided with a long cord to enable a user to operate the back zipper. A drawstring is provided along the bottom of the jacket to help retain the jacket in place. As with the other garments discussed above, if this garment is stored in the backpack, the user must typically remove the backpack to retrieve it. It can also be difficult to operate the rear zipper and to get the jacket on and off. Further, the fit can also be uncomfortable, particularly when worn over a backpack that extends above a user's shoulders. Further still, as with backpacking ponchos, the extra fabric needed for this oversized jacket may also interfere with a user's movements and dexterity.

SUMMARY OF THE INVENTION

It is therefore an object of the present invention to provide a garment that protects a user and the user's backpack from rain and wind.

It is a further object of the present invention to provide a garment of the above type that is quick and easy to put on and take off without removing the backpack from the user's back.

It is a still further object of the present invention to provide a garment of the above type that does a superior job of keeping both the user and the backpack dry, even in windy rainstorms.

It is a still further object of the present invention to provide a garment of the above type that provides for superior ventilation while the garment is worn over the user and backpack.

It is a still further object of the present invention to provide a garment of the above type that provides for a superior fit and that does not impair a user's movement or dexterity.

It is a still further object of the present invention to provide a method of donning a garment to cover both the user and the user's backpack without the need to remove the backpack from the user's back.

Toward the fulfillment of these and other objects and advantages, the garment of the present invention comprises a back panel, means for tensioning the back panel about a backpack, and a front panel. The tensioning means extends around a front portion of the back panel, along upper, lower, and side portions of the back panel. The tensioning means may be a drawstring. The front panel may have a hood, arm openings, and sleeves. The back panel forms a back chamber sized to fit over a backpack. The back chamber preferably has a maximum volume of greater than or equal to approximately 2 cubic feet. The back chamber also preferably has a depth of greater than or equal to approximately 8 inches, a width of greater than or equal to approximately 18 inches, and a height of greater than or equal to approximately 24 inches. In use, the back panel is placed over a backpack with the front panel positioned between the back panel and the backpack. The backpack is then placed on the user's back. When the user wants to deploy the front panel, the user removes the front panel from between the back panel and the backpack without removing the backpack. The user may then place his or her arms through arm openings or sleeves and may place the hood over his or her head.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
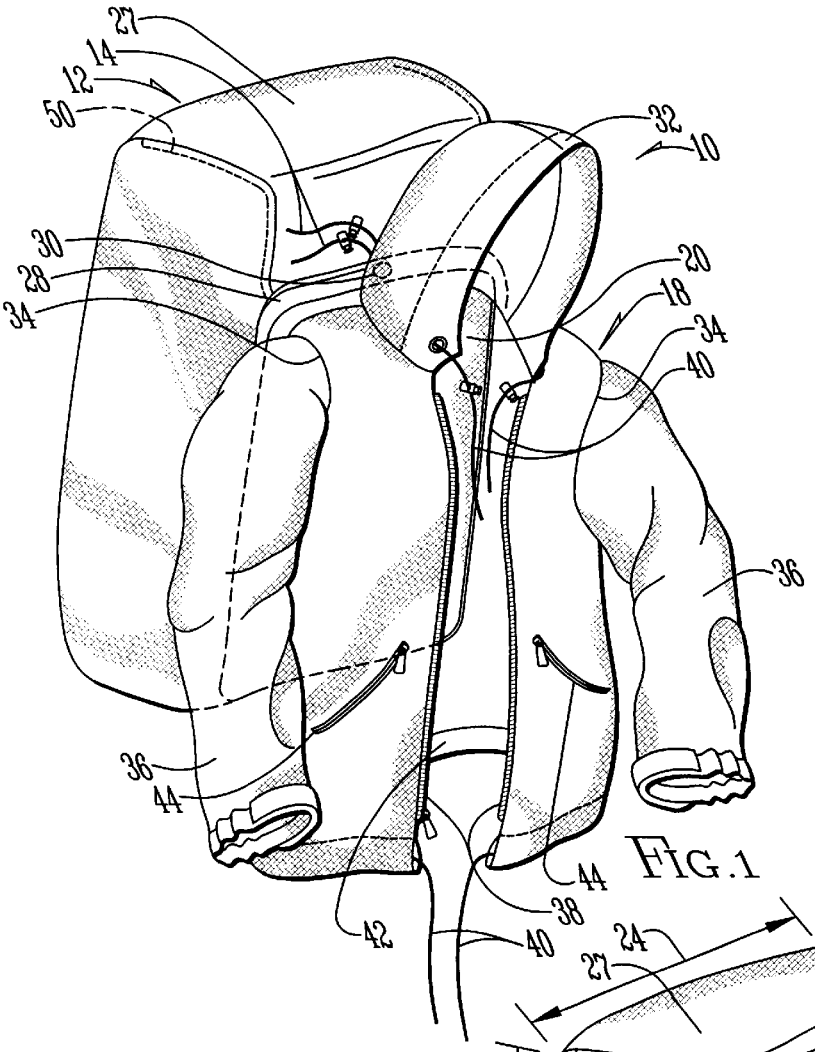
FIG. 1 is a side elevation of a garment of the present invention.

Referring to FIG. 1, the reference numeral 10 refers in general to a garment of the present invention. The garment 10 comprises a back panel 12, a drawstring or other tensioning means 14 for tensioning the back panel 12 about a backpack 16, and a front panel 18. The garment 10 is preferably made from a water or wind resistant fabric but may be made from any conventional material.

Figure 2:
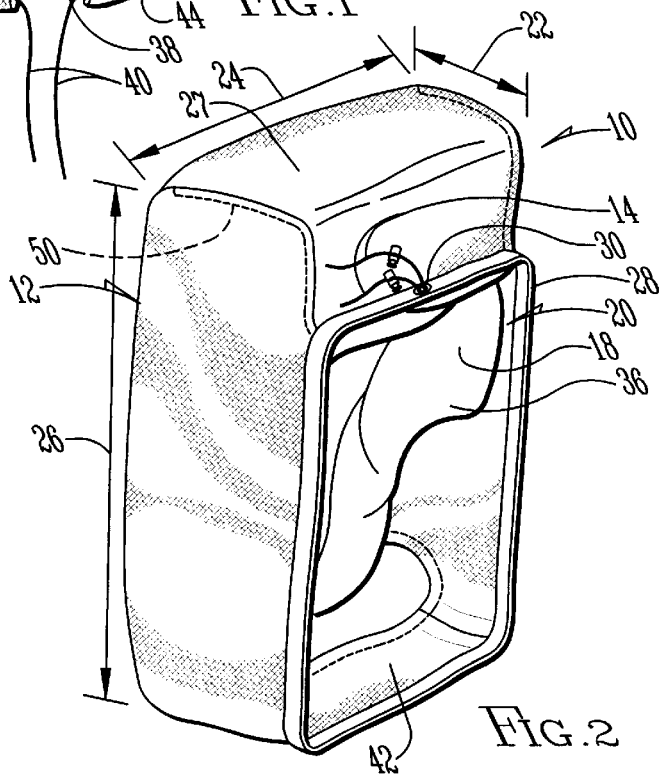
FIG. 2 is side elevation of a garment of the present invention, highlighting the volume of a back chamber of a back panel.

As best seen in FIG. 2, the back panel 12 is sized to form a back chamber 20 that will fit over a backpack 16. The fabric or material of which the garment 10 is made will typically be relatively supple or flaccid, so the fabric or material may be folded or crumpled to take any number of shapes. It is understood that references to a "maximum" volume, depth, width, or height are intended to refer to relevant measurements or dimensions while the fabric or material is in an unfolded or uncrumpled state along the relevant dimension or dimensions, similar to the shape of the back panel 12 and back chamber 20 as depicted in FIG. 2. The back chamber 20 has a maximum volume that is preferably greater than or equal to approximately 2 cubic feet, that is more preferably greater than or equal to approximately 3 cubic feet, and that is most preferably greater than or equal to approximately 4 cubic feet. The back chamber 20 has a depth 22, width 24, and height 26. The maximum depth 22 is preferably greater than or equal to approximately 8 inches and is more preferably greater than or equal to approximately 11 inches. The depth 22 may vary along the width 24 or height 26 of the chamber 20 for a better or custom fit over a desired backpack 16. The maximum width 24 is preferably greater than or equal to approximately 18 inches and is more preferably greater than or equal to approximately 19 inches. The width 24 may vary along the depth 22 or height 26 of the chamber 20 for a better or custom fit over a desired backpack 16. The maximum height 26 is preferably greater than or equal to approximately 24 inches and is more preferably greater than or equal to approximately 33 inches. The height 26 may vary along the depth 22 or width 24 of the chamber 20 for a better or custom fit over a desired backpack 16.

The drawstring 14 extends around a front portion of the back panel 12, along upper, lower, and side portions of the back panel 12. In the preferred embodiment, the drawstring 14 extends along the upper portion of the back panel 12 at a position below a top 27 of the back panel. A fabric loop 28 is provided to retain the drawstring 14 in place. Ends of the drawstring 14 preferably exit the loop 28 through an eyelet 30 provided in an upper, centered position, near the front edge of the back panel 12. Although a drawstring 14 is preferred, any conventional means may be used for tensioning the back panel 12 about the backpack 16 so that the back panel will remain in place on the backpack 16. For example, an elastic band may be used in place of a drawstring. It is of course understood that the drawstring 14 may be made from any number of different materials and may be elastic or inelastic. It is also understood that the drawstring 14 may be formed by one or more segments of string or cord that may or may not be connected to each other.

The front panel 18 is secured to the back panel 12 and may take any number of forms.

The front panel 18 preferably has a hood 32, arm openings 34, and sleeves 36. Opposite sides of the front panel 18 may be secured such as by using a zipper 38 at the front. Additional drawstrings 40 may be provided, such as at the base of the hood 32 and at a lower portion of the front panel 18. The front panel 18 may also have a tail portion 42 extending below the back panel 12. Vents 44, such as zippered vents, may be provided in various locations on the garment 10. It is understood that the front panel 18 may be formed in any number of combinations. For example, the front panel 18 may consist solely of a hood 32, may consist solely of two opposing sides with arm openings 34 similar to a vest, may include or not include sleeves 36, and may incorporate various, similar combinations. As seen in FIG. 2, the opening between the front panel 18 and back panel 12, encircled by the loop 28 and drawstring 14, enables the front panel 18 to be folded or tucked into the back chamber 20 formed by the back panel 12. It is understood that the term "panel" as used herein is not limited to a single piece of material and may include a number of pieces that may or may not be contiguous.

Figure 3:
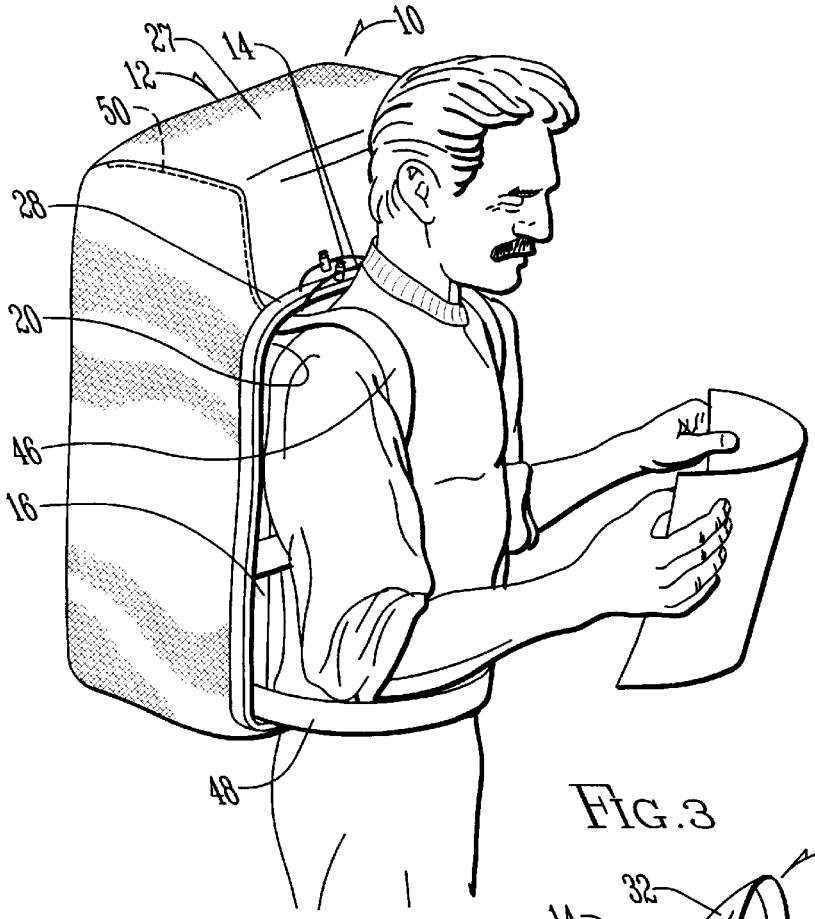
FIG. 3 is side elevation of a garment of the present invention in place over a backpack.
Figure 4:
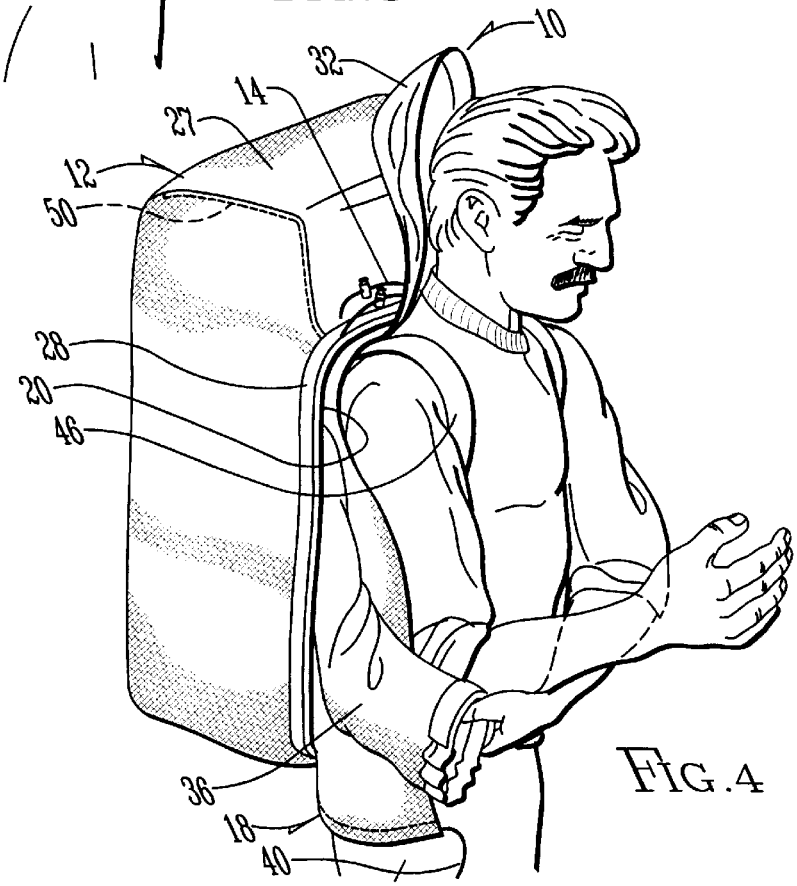
FIG. 4 is a side elevation of a garment of the present invention with a front panel removed from between the back panel and backpack.
Figure 5:
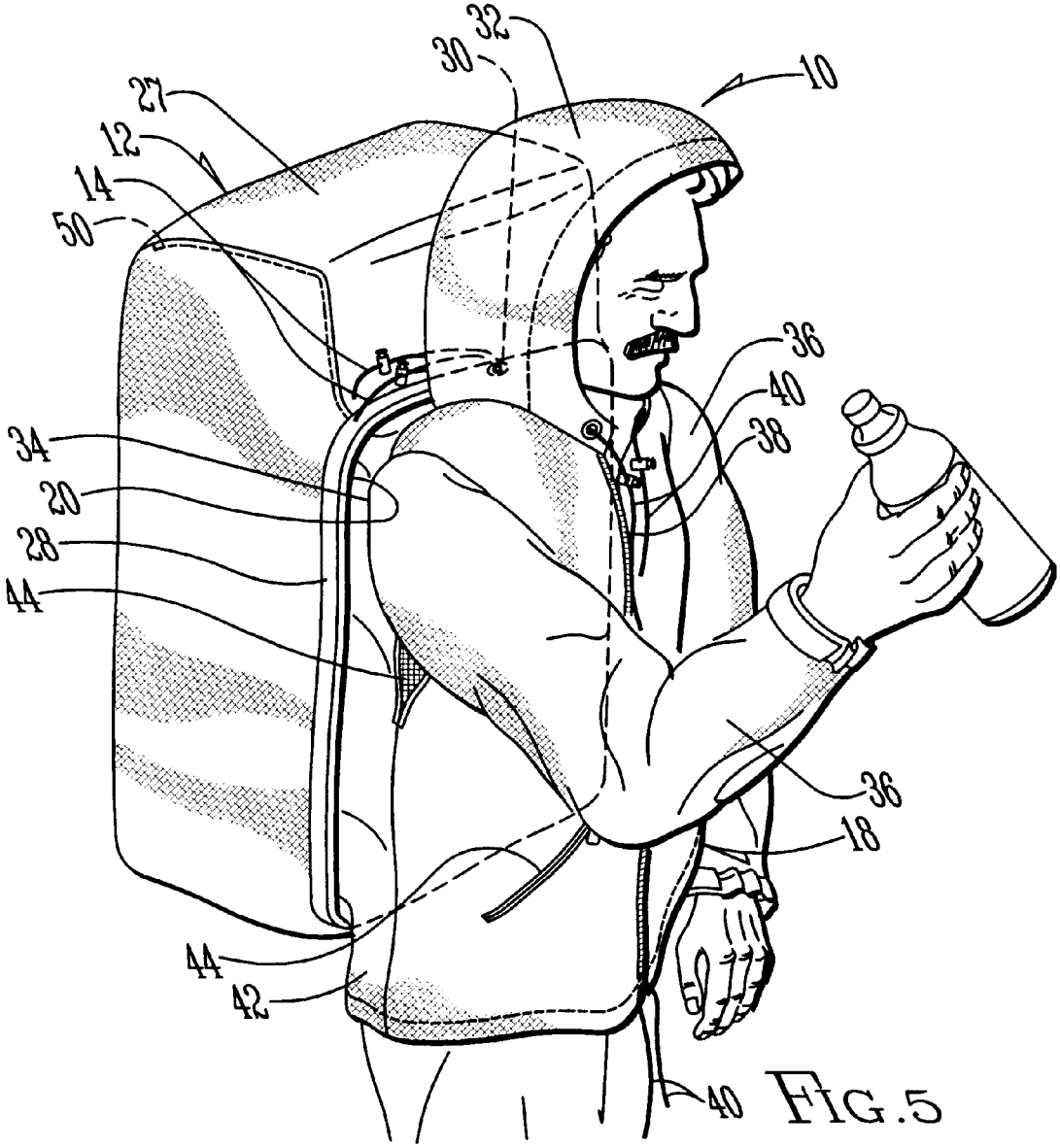
FIG. 5 is a side elevation of a garment of the present invention fully deployed.

Referring to FIGS. 3–5, in operation, a user places the back panel 12 over a backpack 16 with the front panel 18 folded or tucked away so that all or a substantial portion of the front panel 18 is positioned between the back panel 12 and backpack 16. The user tightens the drawstring 14 to tension the back panel 12 about the backpack 16. Tightening the drawstring 14 keeps the back panel 12 in place on the backpack 16 and retains the front panel 18 tucked or folded out of the way between the back panel 12 and backpack 16. The user then places the backpack 16 on his or her back, as illustrated in FIG. 3. The straps 46 and waist belt 48 of the backpack 16 may be seen in FIG. 3 and will typically be exposed until the front panel 18 is deployed. When the user wishes to deploy or use the front panel 18, the user may do so without removing the backpack 16. The user loosens the drawstring 14 and withdraws the front panel 18 from between the back panel 12 and backpack 16, as illustrated in FIG. 4. The user is then free to place his or her arms through the arm openings 34 and sleeves 36 and to put the hood 32 on his or her head. The user may secure the zipper 38 and tighten drawstrings 40 for better protection against rain or wind. The user may also retighten drawstring 14 for a better fit and for better retention of the back panel 12 over the backpack 16. As best seen in FIG. 5, the back panel 12 is sized and disposed so that the back chamber 20 conveniently fits over a backpack 16 even when an upper portion of the backpack 16 extends above a user's shoulders. In that regard, the back panel 12 is configured to fit over a backpack 16 worn by a user, and extending above a user's shoulders, without urging the front panel 18 upward, away from a user's head or shoulders while the user's arms are through the arm openings 34. This may be accomplished in any number of ways, such as by having the loop 28 and drawstring 14 traverse an upper portion of the back panel 12 displaced a desired distance from the top 27 of the back panel 12. A substantially L-shaped seam 50 may also be used along opposing sides of an upper portion of the back panel 12. When in position on the user a relatively vertical segment of the seam 50 extends upward from the loop 28 and front panel 18 along a portion of the height 26 and a relatively horizontal portion of the seam 50 extends rearward, along all or a portion of the depth 22. It is envisioned that the garments may be made with back panels 12 that are specially sized for a customized fit on particular makes and models of popular backpacks.

Other modifications, changes, and substitutions are intended in the foregoing, and in some instances, some features of the invention will be employed without a corresponding use of other features. For example, the front panel 18 may include any combination of elements, such as a hood 32, sleeves 36, a tail portion 42, vents 44, and drawstrings 40. The front panel 18 and back panel 12 may also include any number of additional conventional features, including vents 44, pouches, pockets, clasps and the like. Although the embodiment depicted includes a fabric loop 28 to retain the drawstring 14 in place, the loop 28 may be replaced with any number of conventional means for retaining the drawstring 14. Similarly, although the ends of the drawstring 14 are shown passing through a single eyelet 30, each drawstring end may pass through a separate eyelet or through any type of opening. Finally, all examples and quantitative amounts are given by way of example only and are not intended to limit the scope of the invention. Accordingly, it is appropriate that the appended claims be construed broadly and in a manner consistent with the scope of the invention.

What is claimed is:

1. A garment, comprising:

a back panel having upper, lower, and side portions;

means for tensioning said back panel about a backpack, said tensioning means extending around a front portion of said back panel along said upper, lower, and side portions; and a front panel secured to said back panel, said front panel having first and second arm openings provided therein.

2. The garment of claim 1, wherein said front panel further comprises a hood.

3. The garment of claim 1, wherein said front panel further comprises first and second sleeves secured adjacent said first and second arm openings respectively.

4. The garment of claim 1, wherein said tensioning means comprises a first drawstring.

5. The garment of claim 4, wherein said drawstring is adjustable at said upper portion of said back panel.

6. The garment of claim 1, wherein said back panel forms a back chamber, said back chamber having a maximum volume of greater than or equal to approximately 2 cubic feet.

7. The garment of claim 1, wherein said back panel forms a back chamber, said back chamber having a maximum depth of greater than or equal to approximately 8 inches, having a maximum width of greater than or equal to approximately 18 inches, and having a maximum height of greater than or equal to approximately 24 inches.

8. The garment of claim 1, wherein said back panel forms a back chamber, said back chamber being sized to fit over a backpack worn by and extending above a user's shoulders, said back panel being configured to fit over said backpack worn by said user without urging said front panel upward, away from said user's shoulders while said user's arms are through said first and second arm openings.

9. A garment, comprising:

a back panel having upper, lower, and side portions;

a drawstring extending around a front portion of said back panel along said upper, lower, and side portions; and a front panel secured to said back panel, said front panel comprising a hood.

10. The garment of claim 9, wherein said front panel further comprises first and second sides, first and second arm openings being provided in said first and second sides, respectively.

11. The garment of claim 10, wherein said back panel forms a back chamber, said back chamber being sized to fit over a backpack worn by and extending above a user's shoulders, said back panel being configured to fit over said backpack worn by said user without urging said front panel upward, away from said user's shoulders while said user's arms are through said first and second arm openings.

12. The garment of claim 9, wherein said back panel forms a back chamber, said back chamber having a maximum volume of greater than or equal to approximately 2 cubic feet.

13. The garment of claim 9, wherein said back panel forms a back chamber, said back chamber having a maximum depth of greater than or equal to approximately 8 inches, having a maximum width of greater than or equal to approximately 18 inches, and having a maximum height of greater than or equal to approximately 24 inches.

14. The garment of claim 9, wherein said drawstring is adjustable at said upper portion of said back panel.

15. A method of donning a garment, comprising:

(1) providing a garment comprising a back panel and a front panel having first and second arm openings;

(2) placing said back panel over a backpack with a substantial portion of said front panel positioned between said back panel and said backpack;

(3) placing said backpack on a user's back;

(4) with said backpack on said user's back, withdrawing said front panel from between said back panel and said backpack; and (5) after step (4), placing said user's arms through said first and second arm openings.

16. The method of claim 15, wherein said front panel further comprises a hood, and further comprising, after step (4), placing said hood over said user's head.

17. The method of claim 16, wherein said front panel further comprises first and second sleeves secured adjacent said first and second arm openings, respectively, and wherein step (5) comprises, after step (4), placing said user's arms through said first and second arm openings and through said first and second sleeves.

18. The method of claim 15, further comprising:

after step (2) and before step (4), tightening a drawstring to tension said back panel about said backpack.

19. The method of claim 18, further comprising:

after step (3) and before step (4), loosening said drawstring.

20. The method of claim 19, further comprising:

after step (5), tightening said drawstring.

* * * * *